US008016259B2

(12) United States Patent
Schneider et al.

(10) Patent No.: US 8,016,259 B2
(45) Date of Patent: Sep. 13, 2011

(54) REFRACTORY FURNACE COVERS AND METHODS OF CONSTRUCTING SAME

(75) Inventors: Robert A. Schneider, O'Fallon, MO (US); David A. Ehrhardt, Newburgh, IN (US)

(73) Assignee: Specialty Minerals (Michigan) Inc., Bingham Farms, MI (US)

( * ) Notice: Subject to any disclaimer, the term of this patent is extended or adjusted under 35 U.S.C. 154(b) by 929 days.

(21) Appl. No.: 11/270,863

(22) Filed: Nov. 9, 2005

(65) Prior Publication Data

US 2007/0292817 A1 Dec. 20, 2007

(51) Int. Cl.
*B28B 7/20* (2006.01)

(52) U.S. Cl. ..... 249/101; 249/131; 266/283; 266/286

(58) Field of Classification Search ..... 249/101, 249/131; 266/283, 286
See application file for complete search history.

(56) References Cited

U.S. PATENT DOCUMENTS

| | | | | |
|---|---|---|---|---|
| 2,465,822 | A | 3/1949 | South | |
| 3,806,076 | A * | 4/1974 | Bryant | 249/20 |
| 3,807,944 | A | 4/1974 | Kranjcich et al. | |
| 4,021,603 | A | 5/1977 | Nanjyo et al. | |
| 4,073,064 | A | 2/1978 | Steever et al. | |
| 4,151,362 | A | 4/1979 | Hart | |
| 4,152,534 | A | 5/1979 | Iwashita | |
| 4,453,253 | A | 6/1984 | Lauria et al. | |
| 4,491,952 | A | 1/1985 | Honkaniemi et al. | |
| 4,637,823 | A | 1/1987 | Dach | |
| 6,017,487 | A * | 1/2000 | Fish | 266/283 |
| 6,524,509 | B1 * | 2/2003 | Shope et al. | 264/246 |
| 6,540,510 | B1 | 4/2003 | Abdullah et al. | |
| 2002/0109262 | A1 * | 8/2002 | Grosz et al. | 264/255 |
| 2005/0194466 | A1 * | 9/2005 | Gist et al. | 239/290 |

OTHER PUBLICATIONS

Golod, "Calculating an Arched Furnace Roof and Framework", 1989, pp. 613-620, Plenum Publishing Corporation.

* cited by examiner

*Primary Examiner* — Matthew Daniels
*Assistant Examiner* — Jacob Thomas Minskey
(74) *Attorney, Agent, or Firm* — Derek S. Jessen; Leon Nigohosian, Jr.

(57) ABSTRACT

Refractory furnace covers and methods for their construction are provided. A method includes providing a molding form base having a molding surface, providing an outer molding frame on the molding form base, and providing at least one inner molding member disposed across and dividing the molding surface into a first molding section and a second molding section. The inner molding member has a first molding surface and a second molding surface located adjacent to and facing the first and second molding sections, respectively, the inner molding member having a protrusion located along the length of the first molding surface. A first molded section of the furnace cover is cast between the outer molding frame and the first molding surface of the inner molding member, the inner molding member is removed, and a second molded section of the furnace cover is cast between the outer molding frame and the first molded section of the furnace cover. A refractory furnace cover includes a first molded section having an edge with a slot located thereon, and a second molded section formed against the previously cast first molded section and having an interlocking key formed in the slot of the first section.

9 Claims, 16 Drawing Sheets

REFRACTORY FURNACE COVERS AND METHODS OF CONSTRUCTING SAME

The invention relates to covers for furnaces for high temperature applications and methods for their manufacture and repair and, more particularly, for refractory covers for molten metal production including, but not limited to, electric arc furnaces for the production of steel or aluminum.

Furnace equipment for the melting of metal is lined with refractory shapes to withstand high operating temperatures. One part of the refractory lined equipment is the roof, which is subject to a multiplicity of potentially destructive conditions including, inter alia, high temperatures, physical abuse, stresses from operational movement and frequent thermal variations. One method conventionally used to fabricate the roof of round, top-charged melting furnaces is to use many interlocking refractory bricks that are generally concentrically located within and sprung against a roof band. As the roof is formed, the diameter of each row of bricks is reduced, therefore requiring a different brick shape to produce the right fit. For a typical furnace having a diameter of 8 meters (26 feet), approximately 6500 bricks in four shapes are required. In use, however, the refractory bricks are "pushed-up" by the charge in the furnace and ultimately fall out resulting in relatively short service lives. Once a section of brick falls out, the entire furnace cover can collapse requiring long, labor intensive repairs.

Another method for constructing a refractory furnace cover is by pre-casting large shapes for later assembly. Furnace covers made by this technique present difficulties in their installation and repair, are expensive to engineer, utilize expensive molds and are time consuming to manufacture. Moreover, conventional pre-cast furnace covers typically experience the same type of failures as seen with the covers using refractory brick.

The foregoing illustrates limitations known to exist in present refractory coating methods and devices. Thus, it is apparent that it would be advantageous to provide an alternative directed to overcoming one or more of the limitations set forth above. Accordingly, alternative methods for manufacturing and repairing a refractory furnace cover is provided including the features more fully disclosed hereinafter.

SUMMARY OF THE INVENTION

Refractory furnace covers and methods for their construction are provided. A method includes providing a molding form base having a molding surface, providing an outer molding frame on the molding form base, and providing at least one inner molding member disposed across and dividing the molding surface into a first molding section and a second molding section. The inner molding member has a first molding surface and a second molding surface located adjacent to and facing the first and second molding sections, respectively, the inner molding member having a protrusion located along the length of the first molding surface. A first molded section of the furnace cover is cast between the outer molding frame and the first molding surface of the inner molding member, the inner molding member is removed, and a second molded section of the furnace cover is cast between the outer molding frame and the first molded section of the furnace cover. A refractory furnace cover includes a first molded section having an edge with a slot located thereon, and a second molded section formed against the previously cast first molded section and having an interlocking key formed in the slot of the first section.

BRIEF DESCRIPTION OF THE DRAWINGS

Features of the present invention will become apparent to those skilled in the art from a reading of the following detailed description in conjunction with the accompanying drawings, wherein.

DETAILED DESCRIPTION OF THE INVENTION

Figure 1:
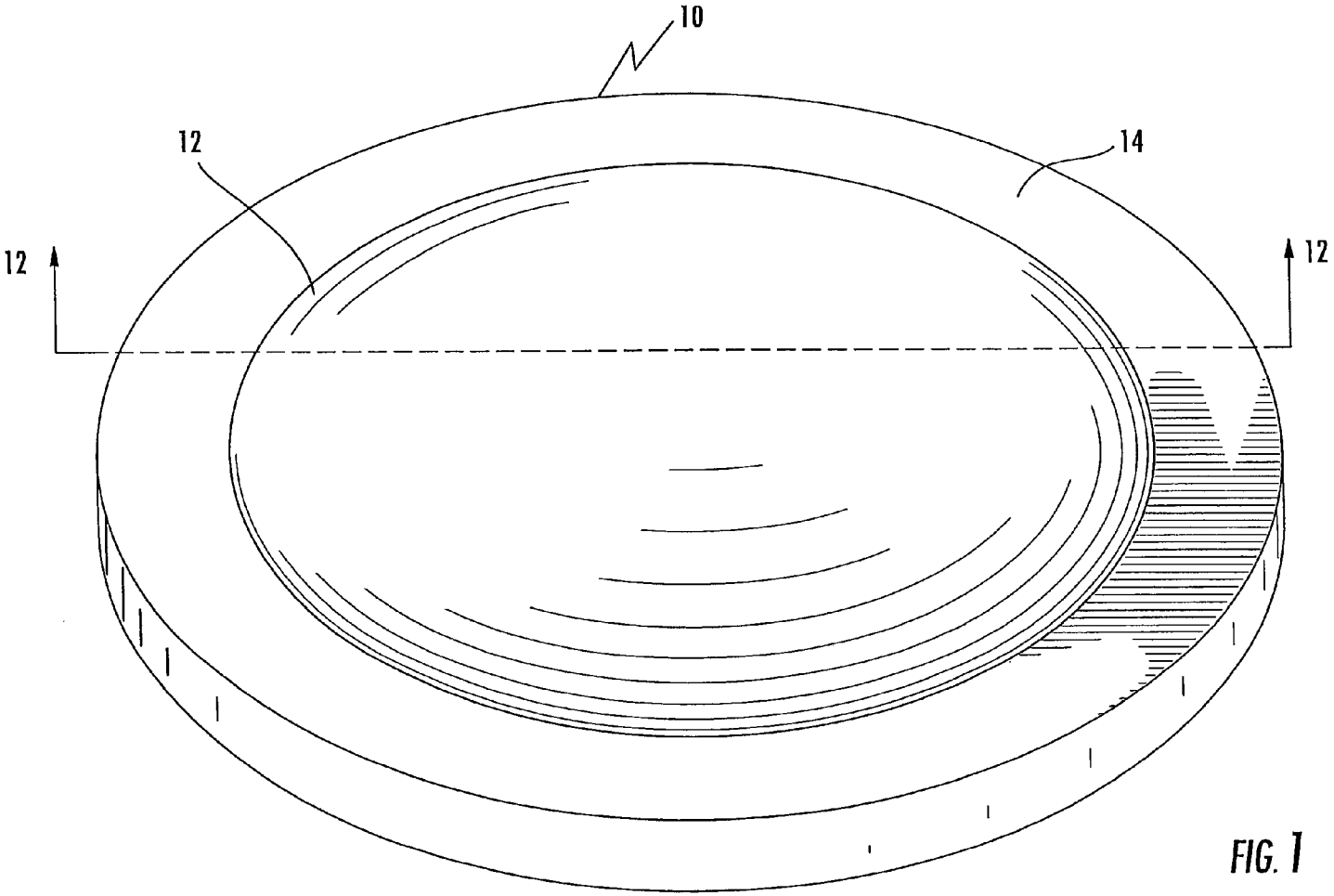
FIG. 1 is a perspective view of a molding form base according to the present invention.

According to the present invention, refractory furnace covers having interlocking constructed joints and methods for their construction using refractory castables are provided. The invention is best understood by reference to the accompanying drawings in which like reference numbers refer to like parts. It is emphasized that, according to common practice, the various dimensions of the apparatus and the associated component parts as shown in the drawings are not to scale and have been enlarged for clarity.

Figure 11:
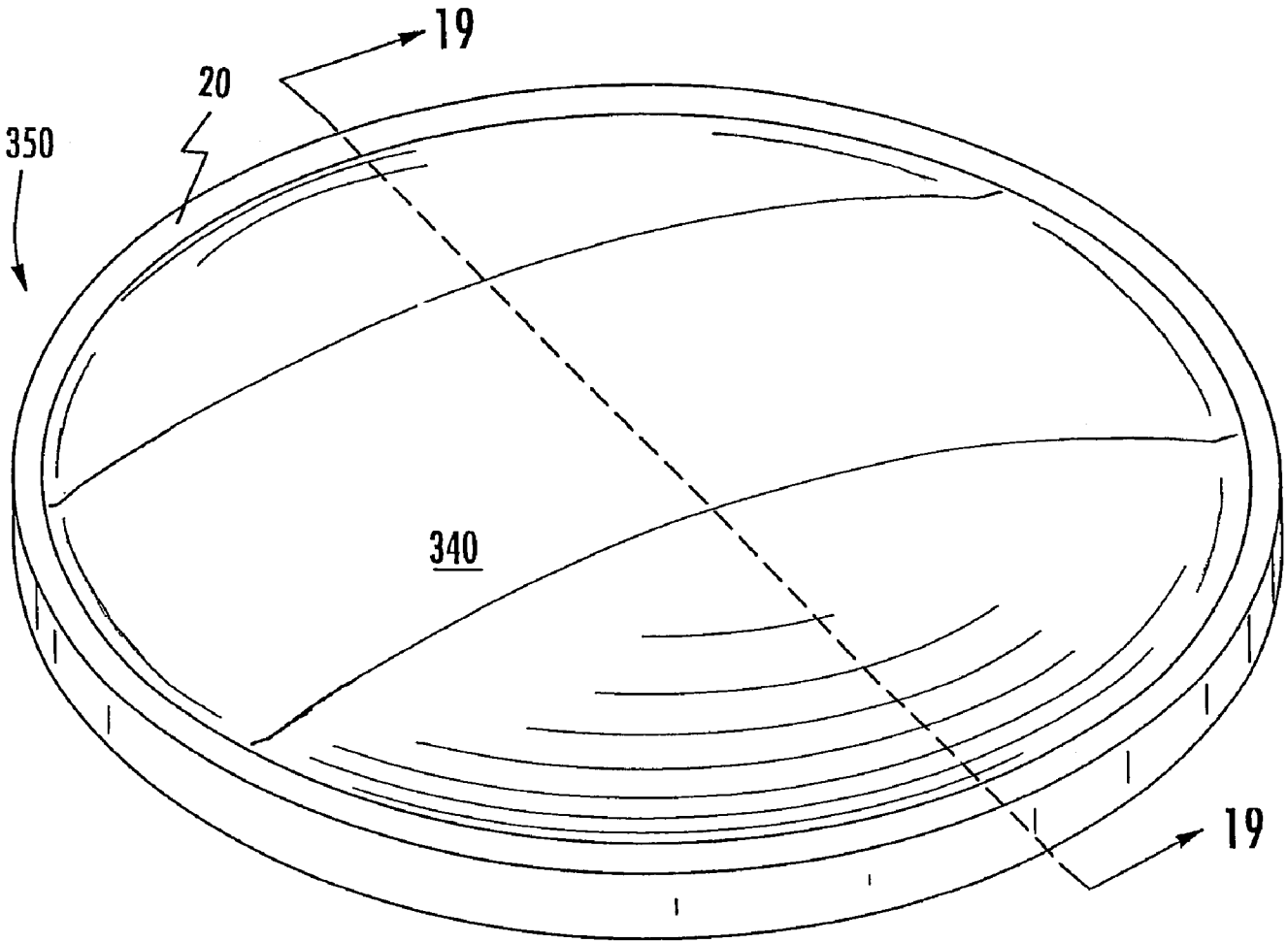
FIG. 11 is the completed furnace cover after removal from the molding form base in FIG. 10.
Figure 12:
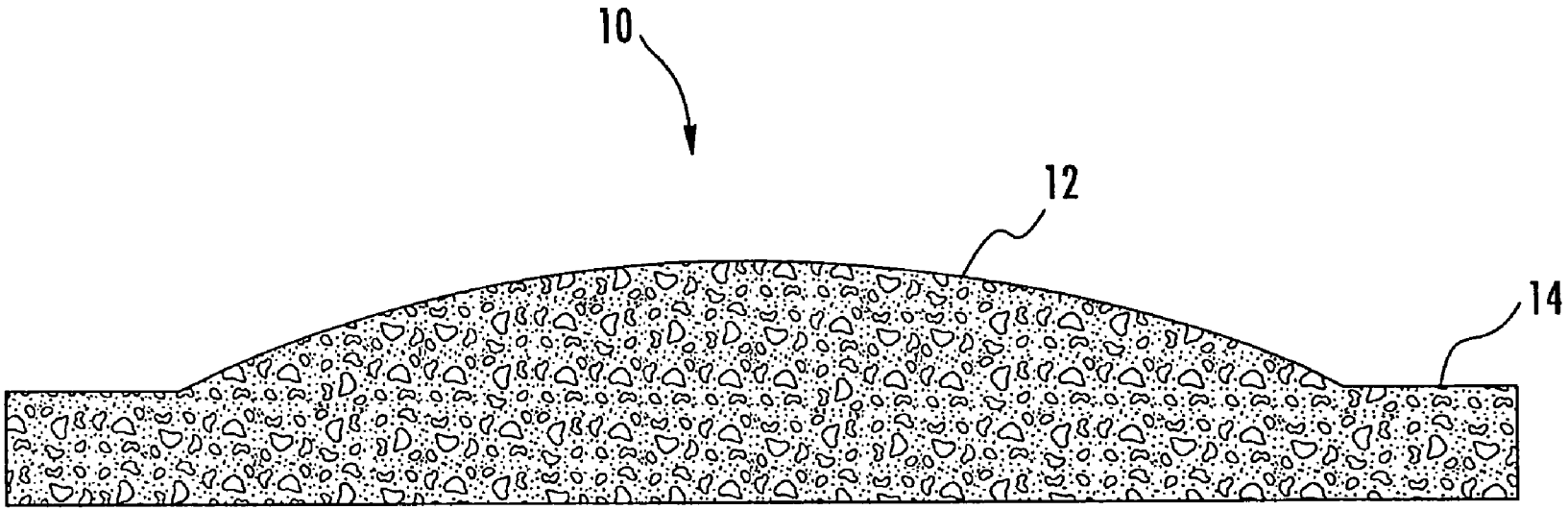
FIG. 12 is a cross-sectional view taken along the sectional line "12-12" in FIG. 1.

Referring now to the drawings, a method of manufacturing a refractory furnace cover 350 is shown in FIGS. 1-20 in which a molding form base 10 is provided having an outer ledge 14 around a periphery of a molding surface 12 as shown in FIGS. 1 and 12. Typically, molding form base 10 is made of concrete, however, may be made of a rigid mold material such as wood or steel. For manufacturing a conventionally shaped dome-type electric arc furnace roof, molding form base 10 may be provided with a molding surface 12 having a dome-shaped profile, as shown, and typically has a diameter of from about 5.5 meters (18 feet) to about 10 meters (34 feet) including the outer edge around the periphery. It is to be understood that molding form base 10 may be provided with other configuration profiles having other shapes and dimensions to cast other furnace cover profiles and shapes as desired.

Figure 2:
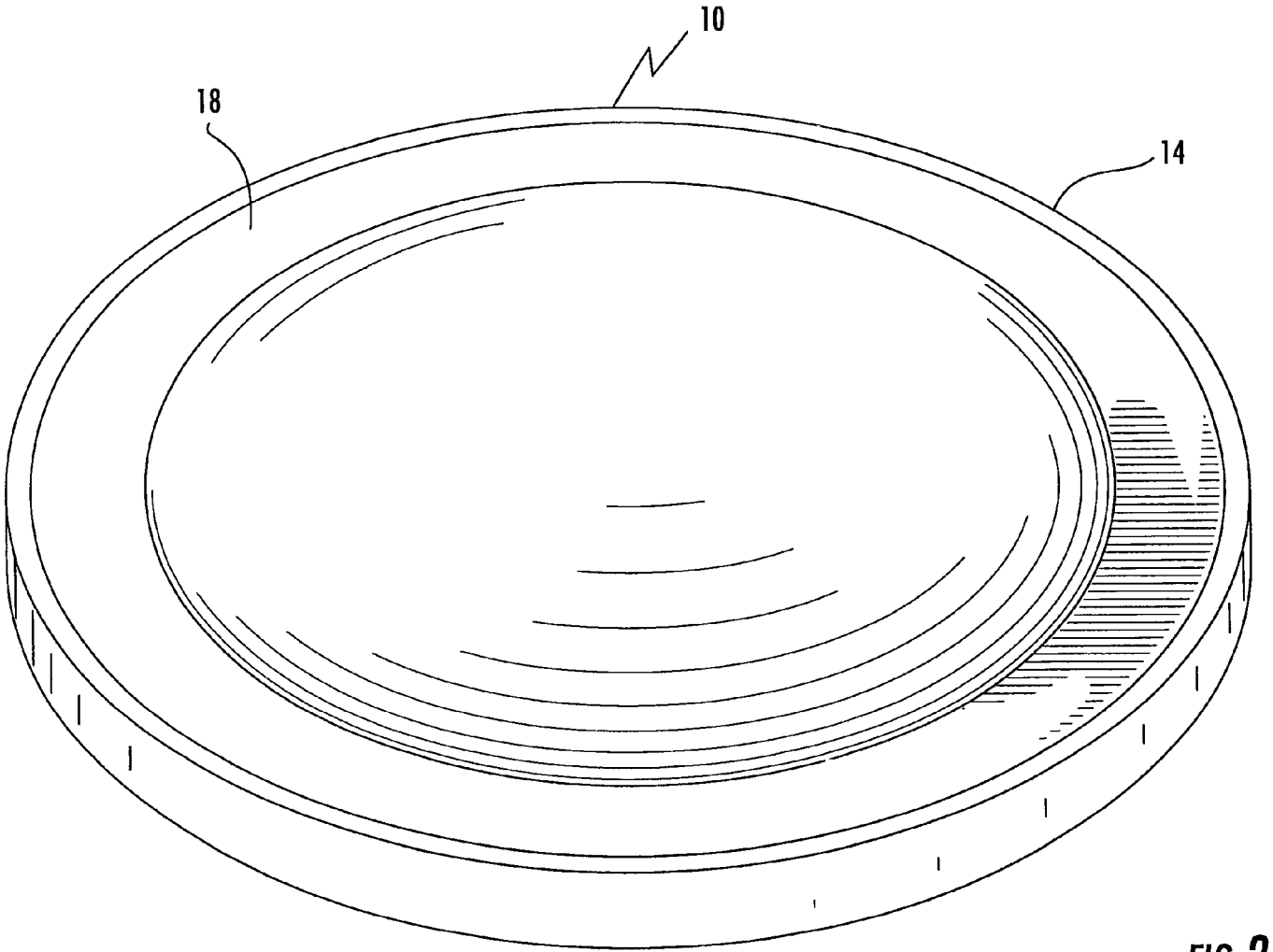
FIG. 2 is a perspective view of a release layer disposed on the molding form base shown in FIG. 1.

As shown in FIG. 2, a release layer 18 can optionally be placed on top of and covering the molding surface 12 to facilitate parting of the refractory material to be cast against the molding surface 12. Release layer 18 can be a plastic sheet or may be any other release agent such as, for example, any type of grease, oil, or mold release agent.

Figure 3:
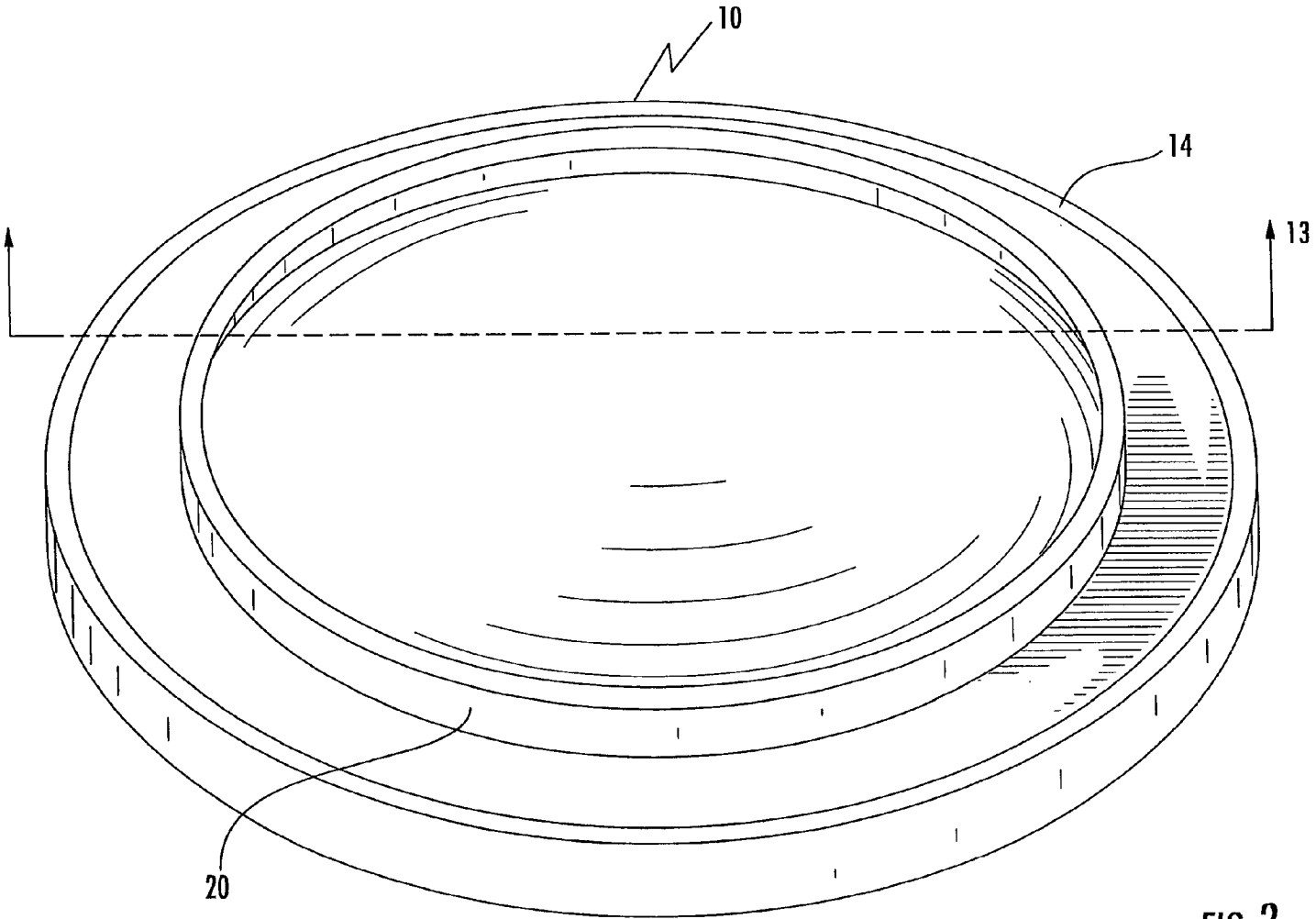
FIG. 3 is a perspective view of an outer molding frame disposed on the molding form base shown in FIG. 2.
Figure 13:
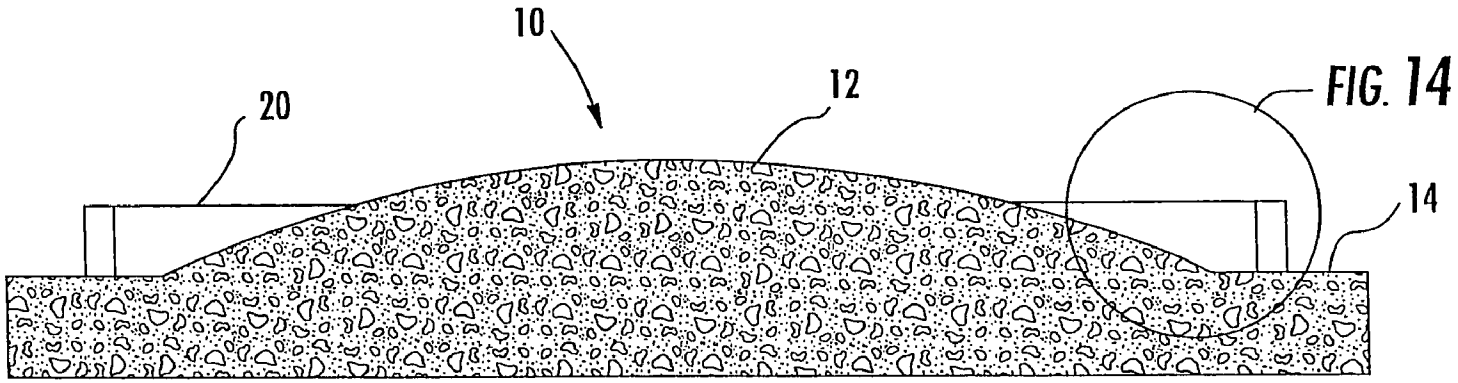
FIG. 13 is a cross-sectional view taken along the sectional line "13-13" in FIG. 3.
Figure 14:
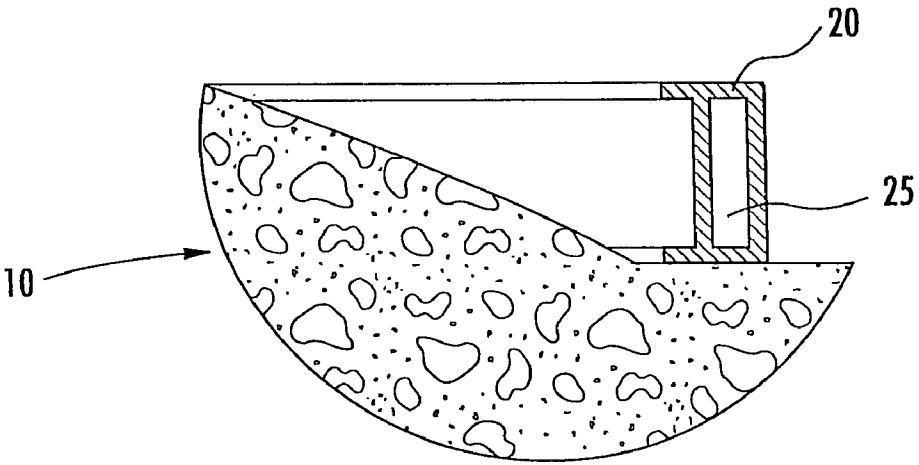
FIG. 14 is an enlarged view of a cross-sectional portion of the outer molding frame shown in FIG. 13.

As shown in FIGS. 3 and 13, an outer molding frame 20 is provided on the outer ledge 14 of the molding form base 10. The outer molding frame 20 defines a wall above molding surface 12, which contains the cast refractory material to be cast. The outer molding frame 20 can be a metal ring on top of the molding form base 10 and on top of the optional release layer 18, if used. As shown in FIG. 14, outer molding frame 20 can be provided as a dome ring having a "c"-channel for incorporation into the cast refractory furnace cover that is to be formed. The dome ring can be made of a steel commonly used in refractory applications, such as a carbon or stainless steel, and can be provided as a double walled structure to define an air cooling chamber 25 as shown through which cooling air may be blown during operation of the furnace on which the furnace cover is placed. Although shown and described as being circular in shape, it will be readily recognized by those skilled in the art that other outer molding frame configurations may be employed to provide the furnace cover shapes desired.

Figure 4:
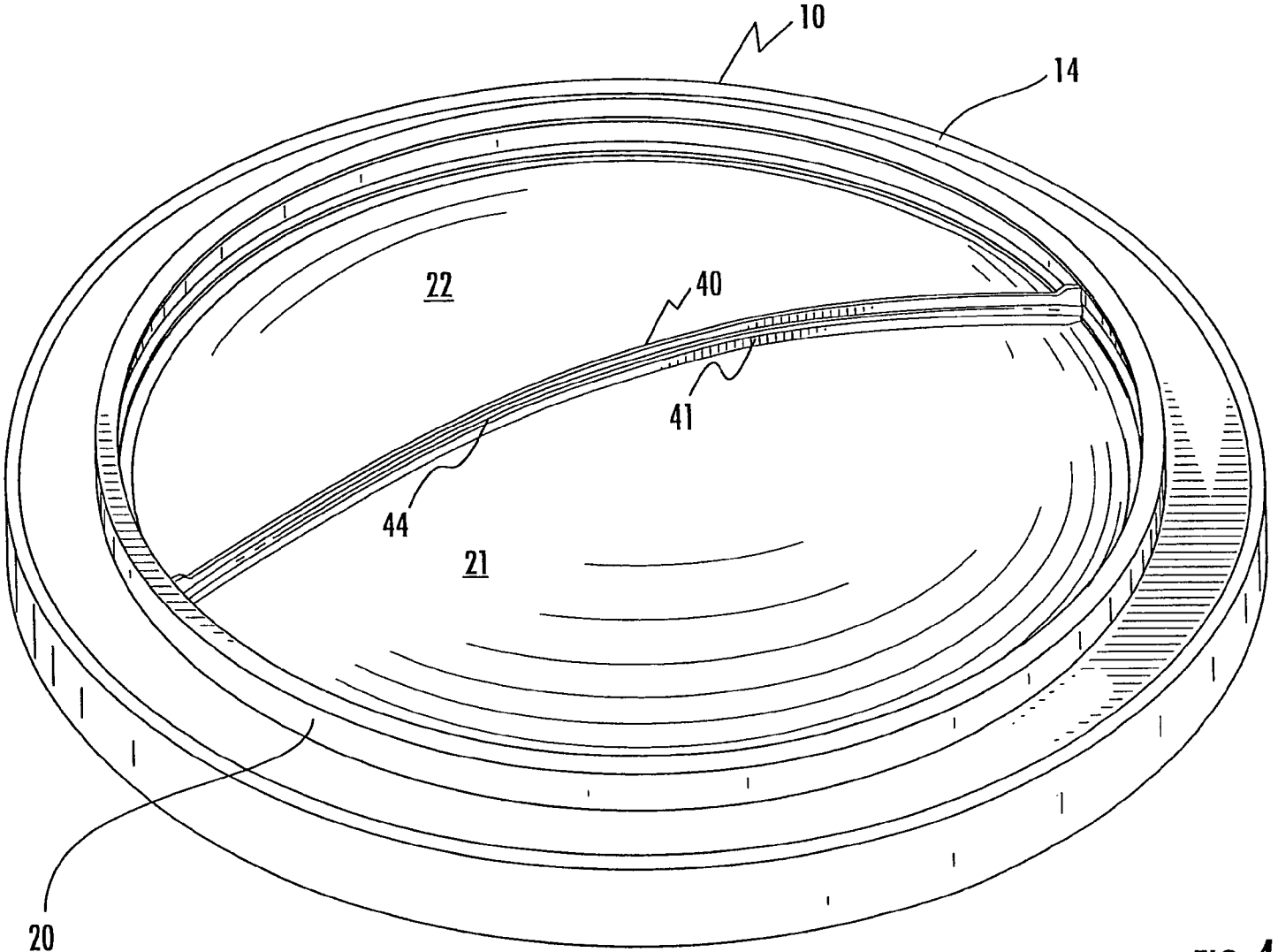
FIG. 4 is a perspective view of an inner molding member traversing the molding form base shown in FIG. 2.

As shown in FIG. 4, at least one inner molding member 40 is disposed across and divides the molding surface 12 into first 21 and second 22 molding sections. The inner molding member 40 has opposed first and second molding surfaces 41 and 42 (shown in FIG. 20) located adjacent to and facing the first and second molding sections 21, 22, respectively. A protrusion 44 is provided and located along the length of the first molding surface 41. By utilizing a single inner molding member 40 as shown, a two-section refractory furnace cover may be produced. In brief, this is accomplished by casting a first molded section of the furnace cover in the first molding section 21 between the outer molding frame 20 and the first molding surface 41 of the inner molding member 40. The inner molding member 40 is then removed to expose a slot formed in the first section by the protrusion 44 removed therefrom. A second molded section of the furnace cover is then cast in the second molding section 22 between the outer molding frame 20 and the surface of the previously cast first section of the furnace cover, thereby forming an interlocking key in the slot of the first section. The casting steps of a two-section furnace cover are similar to and will be readily understood by the more detailed description of FIGS. 5-19, which differ in that a plurality of inner molding members 40 are used to form a multiple-piece furnace cover.

Figure 5:
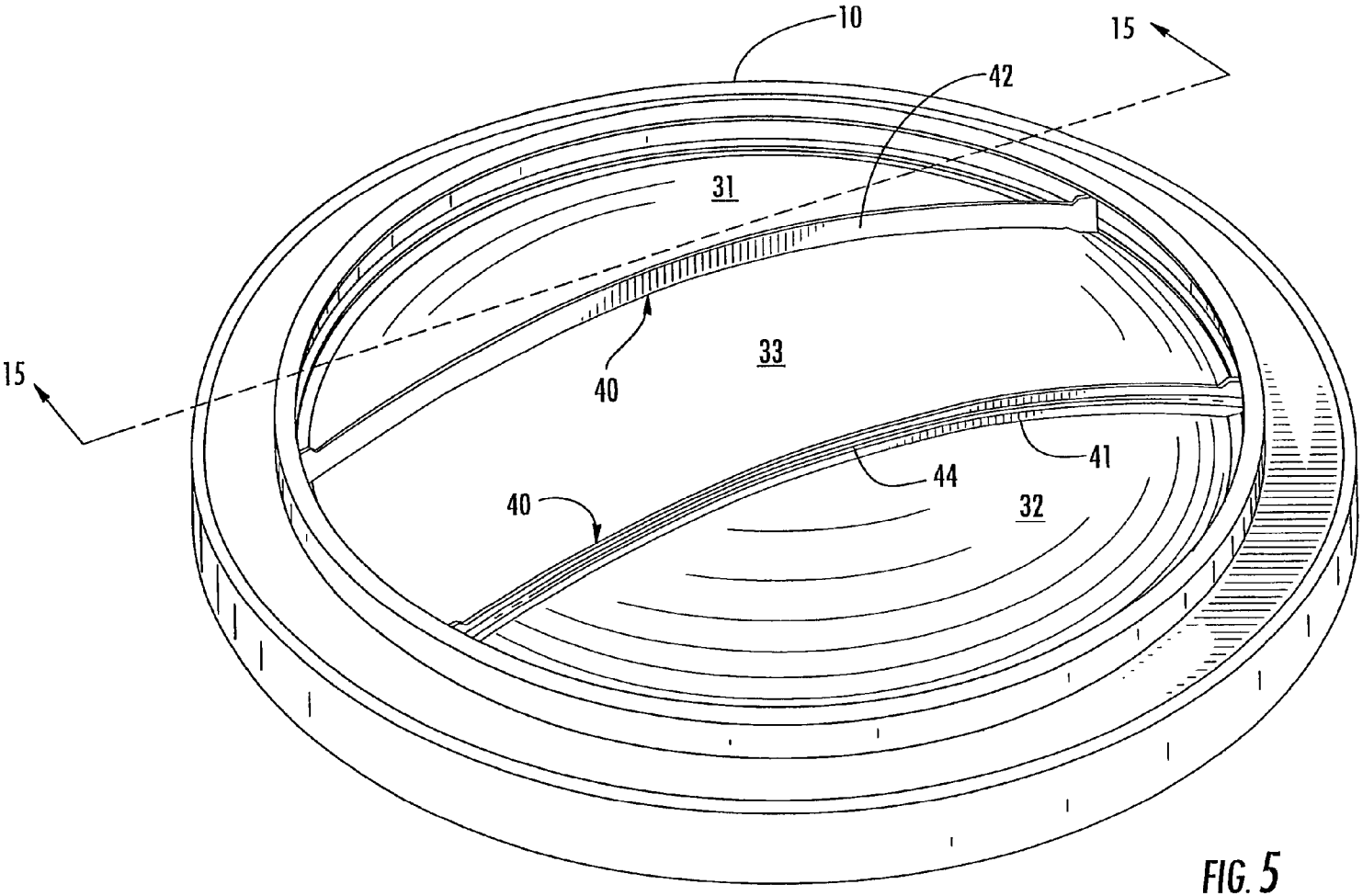
FIG. 5 is a perspective view of inner molding members traversing the molding form base shown in FIG. 2.
Figure 6:
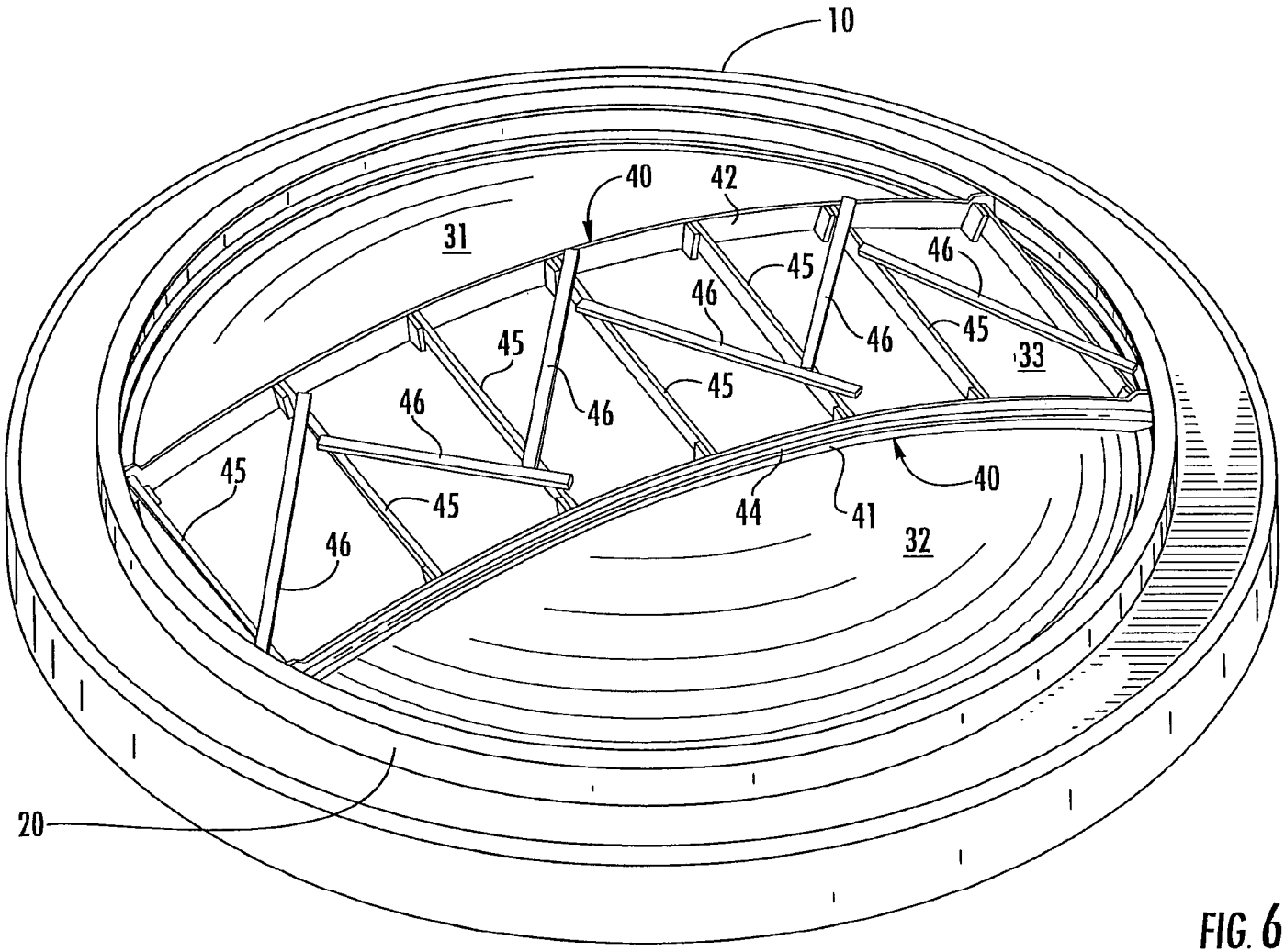
FIG. 6 is a perspective view of the inner molding members shown in FIG. 5 with cross-bracing.
Figure 15:
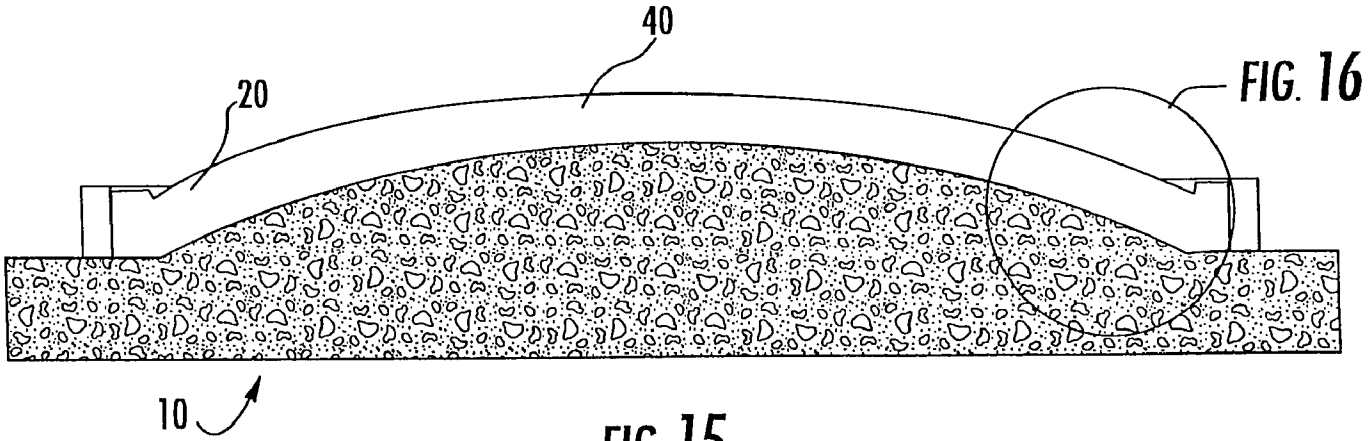
FIG. 15 is a cross-sectional view taken along the sectional line "15-15" in FIG. 5.
Figure 16:
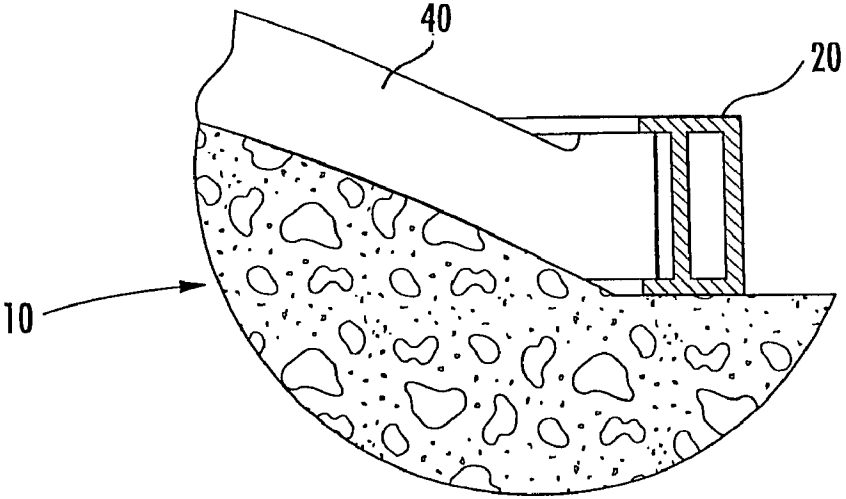
FIG. 16 is an enlarged view of a cross-sectional portion of the inner molding member inserted into the outer molding frame shown in FIG. 15.

The manufacture of a multiple-piece furnace cover having more than two pieces is illustrated in FIG. 5 for which more than one inner molding member 40 is used. In the case of a three-piece construction, two inner molding members 40 are provided that traverse the molding form base 10 and divide the molding surface into a first molding section 31, a second molding section 32, and a third molding section 33. As shown in FIGS. 15 and 16, the ends of the inner molding members 40 are disposed into the "c"-channel portion of the dome ring. As shown in FIG. 6, cross bracing 45, 46 can also be provided for added stability and strength to the inner molding members 40 during casting of the refractory material. Inner molding members 40 and cross-bracing 45, 46 can be made of any substantially rigid material, such as, but not limited to, wood, steel, plastic, plexiglass, and fiberglass. Additional inner molding members 40 may be used to divide the molding form base 10 into multiple molding sections for casting multiple piece refractory furnace covers wherein the number of inner molding members required (n) is one less than the number of molding sections desired (n−1).

To facilitate the cross-bracing of and removal of the inner molding members 40 and molding of the sections during the manufacture of the furnace covers, preferably, the second molding surfaces 42 of the inner molding members 40 are facing each other as shown in FIG. 6. In this manner, after casting a first molded section 310 in first molding section 31 and a second molded section 320 in second molding section 32 and removing any cross-bracing 45, 46, as described in greater detail below, inner molding members 40 may be removed by sliding one laterally toward the other (i.e., toward the diameter of the outer molding frame) to increase the space between the end of the inner molding member 40 and the "c"-channel of the outer molding frame 20 such that the removal of the inner molding members from the "c"-channel is facilitated.

Figure 20:
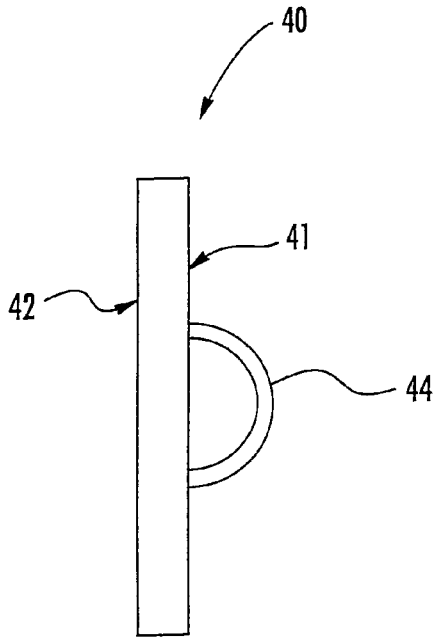
FIG. 20 is a sectional end view of the inner molding member with a protrusion.

Referring to FIG. 20, the protrusion 44 located on the first molding surface 41 of the inner molding member 40 is preferably provided along the entire length of inner molding member 40. The protrusion 44 can be formed for example, by cutting a 8 centimeters (3 inches) diameter PVC pipe in half and attaching a half of the PVC pipe to the first molding surface 41 of the inner molding members 40. The protrusion can be of any geometric shape that would form a slot that would impart an interlocking joint with a key formed therein. Additionally, the surface of the protrusion 44 can be covered by or coated with any refractory form release agent known in the art, such as those mentioned above.

Figure 7:
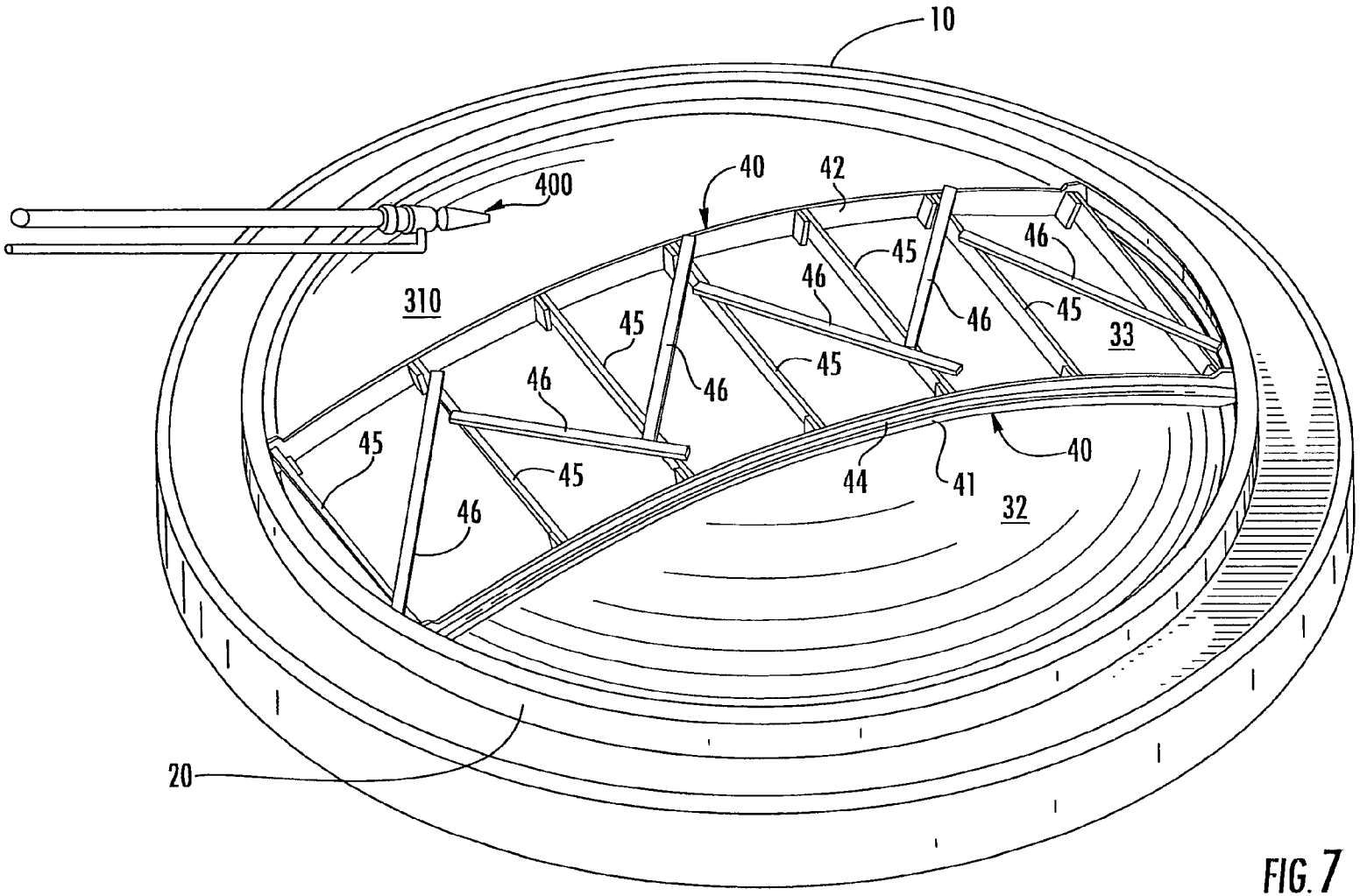
FIG. 7 is a perspective view of a first molded section cast on the molding form base shown in FIG. 6.
Figure 8:
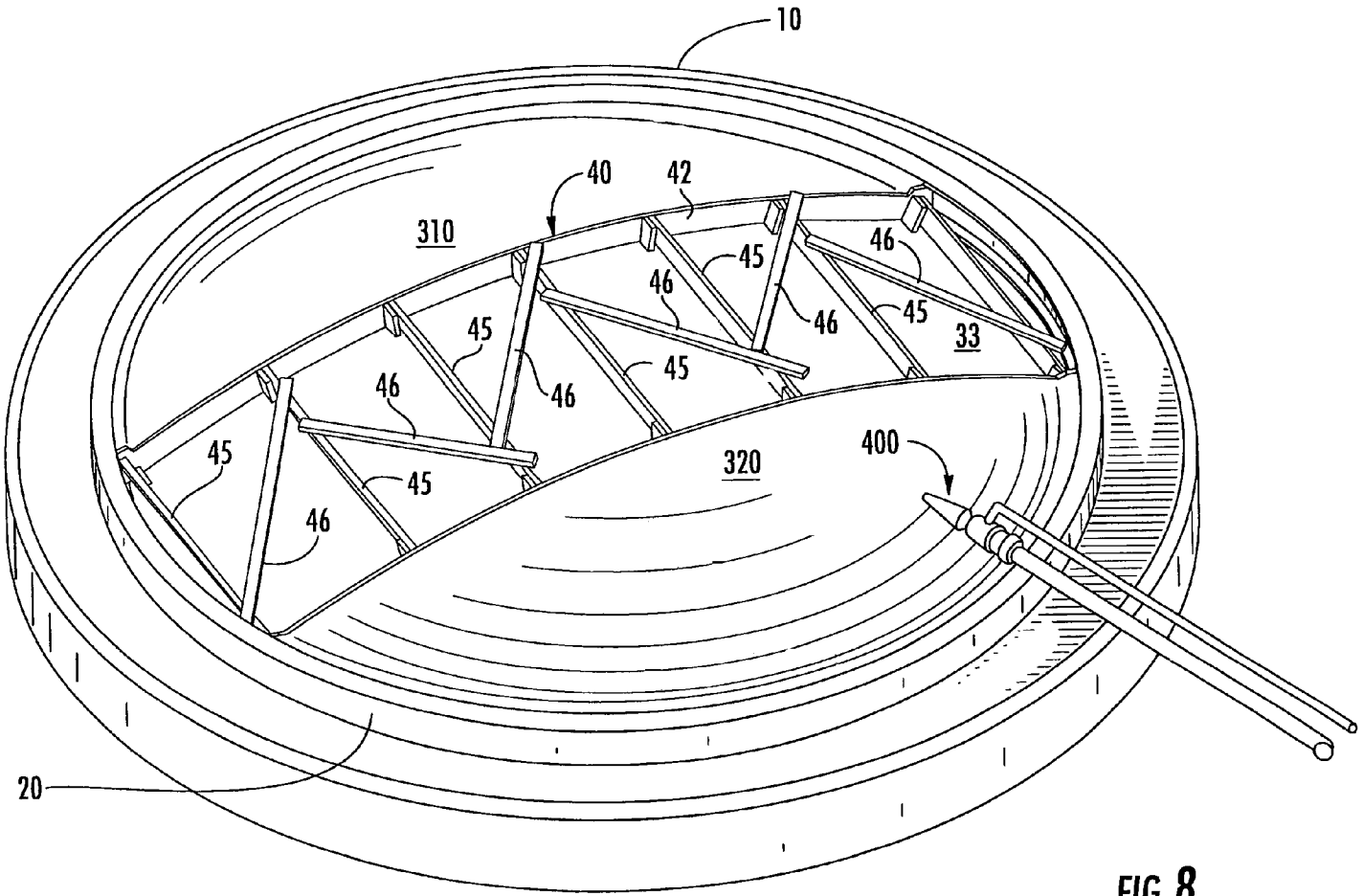
FIG. 8 is a perspective view of a second molded section cast on the molding form base shown in FIG. 7.

Casting of the furnace cover sections will now be described in greater detail. Referring to FIG. 7, a refractory material is cast into the first molding section 31 to form a first molded section 310. Generally, the thickness of first molded section is from about 15 centimeters (6 inches) to about 38 centimeters (15 inches) and typically about 23 centimeters (9 inches). Next, refractory material is cast into the second molding section 32 as shown in FIG. 8 to form a second molded section 320, generally, to match the thickness of the first molded section 310.

Figure 9:
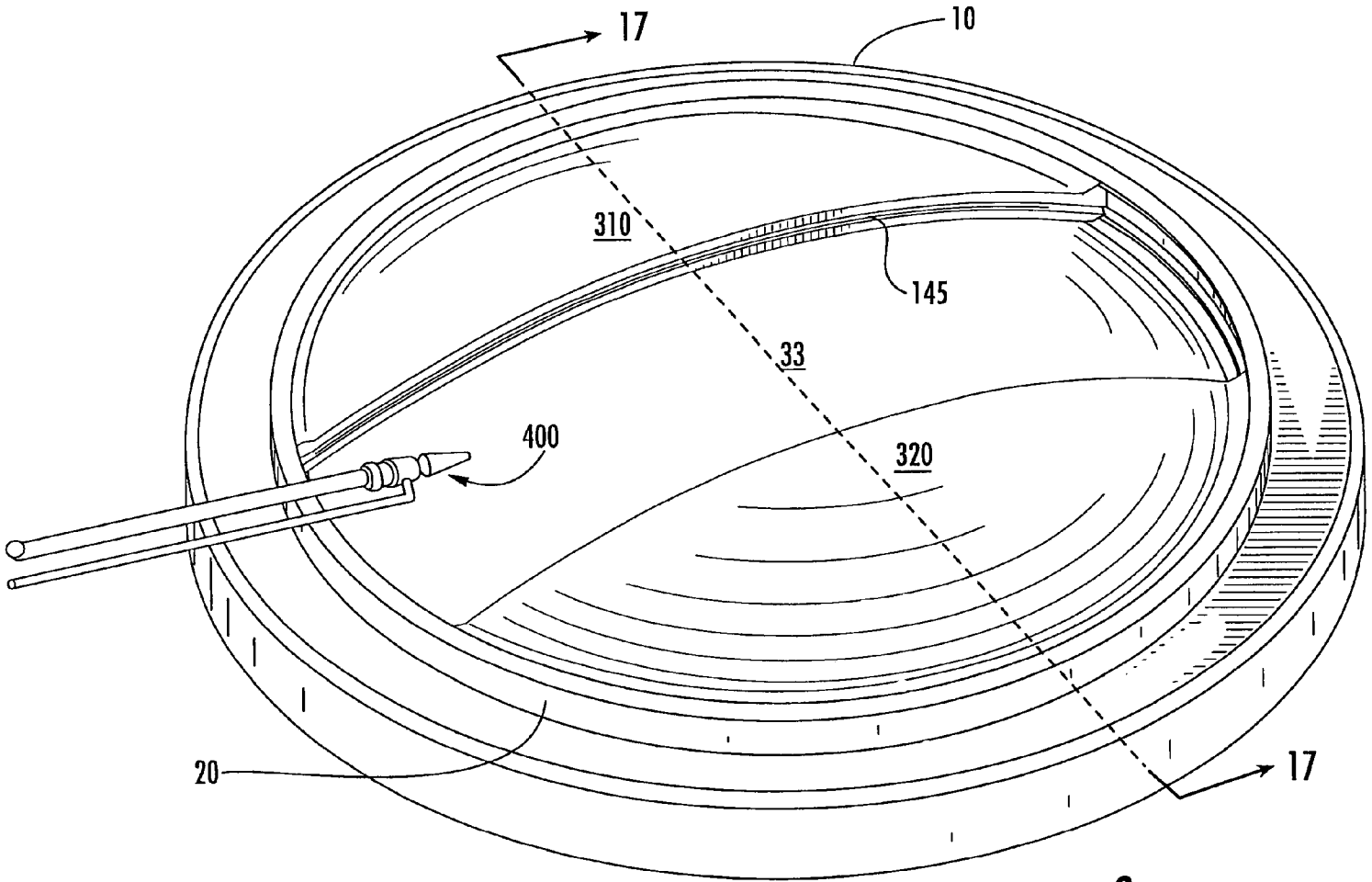
FIG. 9 is a perspective view of the molding form base shown in FIG. 8 after removal of the inner molding members and prior to casting a third molded section.
Figure 17:
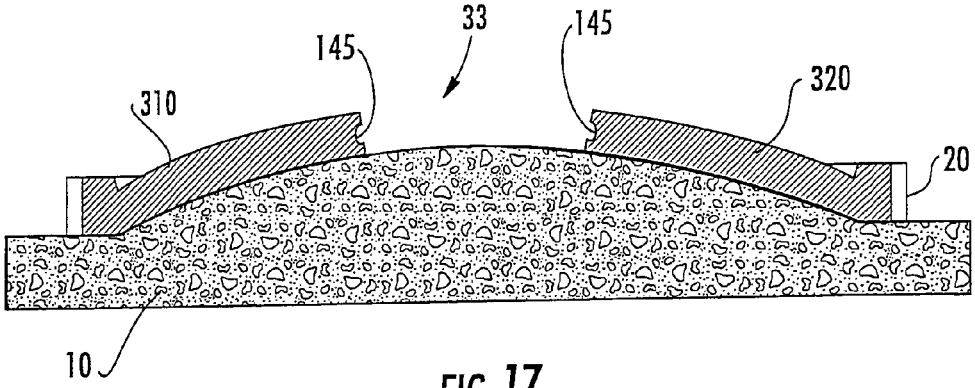
FIG. 17 is a cross-sectional view taken along the sectional line "17-17" in FIG. 9.

The inner molding members 40 are then removed to expose slots 145 formed in the first and second molded sections 310, 320 left by the protrusions 44 removed therefrom as shown in FIGS. 9 and 17. A third molded section 330 is cast in third molding section 33 located between the first molded section 310 and the second molded section 320 to a thickness of that of the adjacent first and second molding sections 310, 320. The third molded section 330 has a surface that conforms to laterally adjacent surfaces of and has keys 146 formed in the slots 145 of the first molded section 310 and second molded section 320, the keys 146 forming interlocking joints between the molding sections. The depth of the cast furnace cover should be of a uniform depth and can generally be about 23 centimeters (9 inches). The third molded section 330 can be cast on the molding form base 10 during removal of the inner molding members 40 or after the inner molding members 40 have been entirely removed from the first and second molded sections 310, 320.

Conventional casting methods can be employed to cast in molding sections 21, 22 and 31, 32, 33 to produce the refractory furnace covers of the invention. Among these methods are gunning methods that project a castable material onto a target substrate for producing or repairing of refractory linings are generally known. One type of gunning method for producing high density, monolithic structures well-suited for manufacturing the refractory furnace covers of the present invention is the shotcrete castable method. In the shotcrete method, a gunning material is produced by mixing a dry material with water in a separate mixing device prior to delivery to a gunning device 400 as is known in the art. The dry powdery material is pre-wet with water in a mixer and then pumped by a delivery pump through a transfer hose to a gunning device which projects the gunning material to a target using compressed air. Usually, a setting agent is added to the gunning material at the nozzle prior to the gunning material being projected onto a furnace wall structure.

Figure 10:
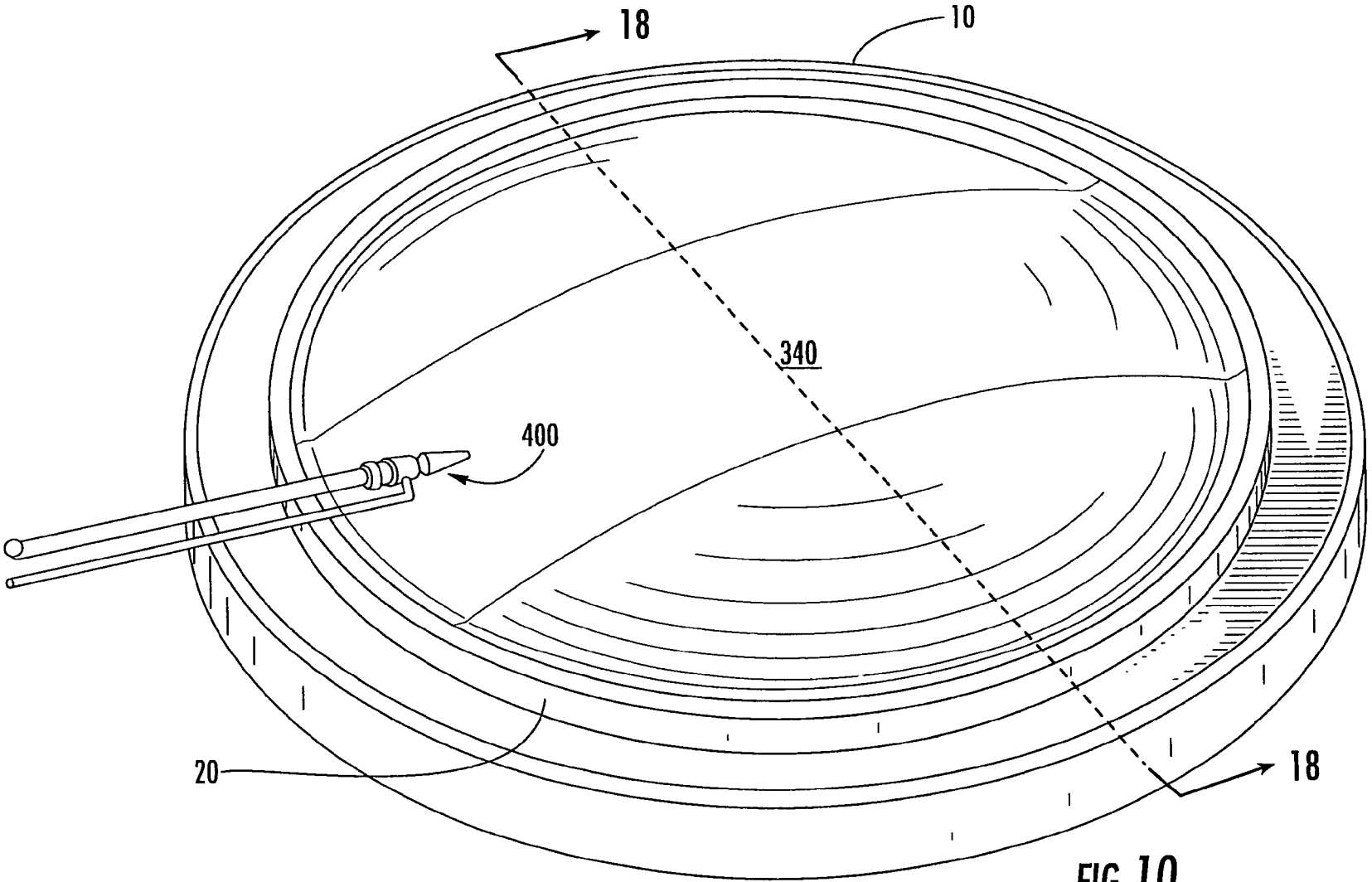
FIG. 10 is a perspective view of FIG. 9 after casting the third molded section and insulating layer and showing the completed furnace cover prior to removal from the molding form base.
Figure 18:
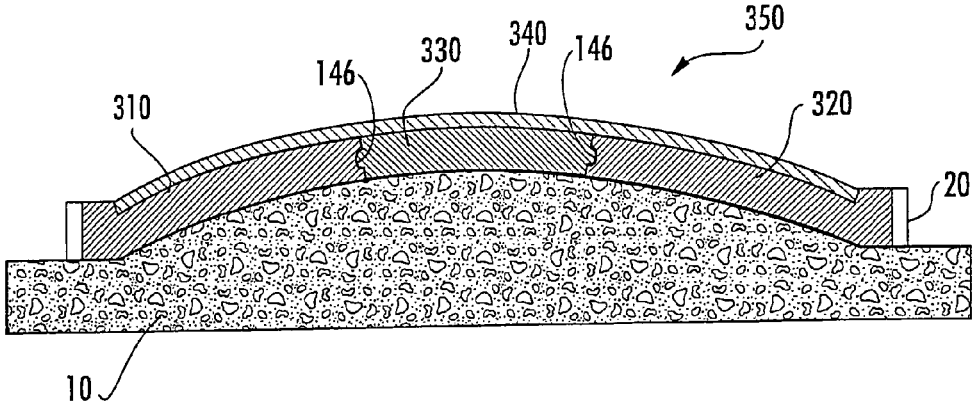
FIG. 18 is a cross-sectional view taken along the sectional line "18-18" in FIG. 10.

Shotcrete castables useful in manufacturing the molded sections of the refractory furnace cover are commercially available refractory materials such as FASTFIRE™ 60 SHOT shotcrete castable (commercially available from MINTEQ International, Inc. a wholly owned subsidiary of Minerals Technologies Inc., New York, N.Y.), which is an alumina-based castable particularly suited as a refractory for use in smelting aluminum. Conventional reinforcing fibers for refractories can be incorporated into the refractory material as is known in the art. In the case of FAST FIRE 60 SHOT shotcrete, additions of 2.5% by weight of fibers can be made utilizing commercially available fibers such as ALFA-I fibers, which are Grade 406 stainless steel, 25 millimeter (1 inch), slit sheet, deformed fiber stainless steel needles, available from Fibercon International, Evans City, Pa. The molding sections can optionally be further coated or covered with an insulating castable to form an insulating layer 340 as shown in FIGS. 10 and 18. Typically the insulating layer 340 is approximately 5 centimeters (2 inches) thick and comprises an insulating castable such as those known in the art, including but not limited to, INSULCRETE® 22 shotcrete castable, also commercially available from MINTEQ International Inc.

Figure 19:
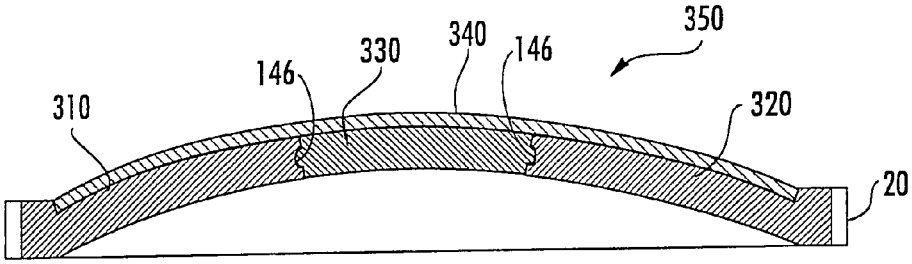
FIG. 19 is a cross-sectional view taken along the sectional line "19-19" in FIG. 11.

Shown in FIGS. 11, 18 and 19 is the completed refractory furnace cover 350 that is removed from the molding form base 10 and allowed to cure prior to being placed on the opening of the furnace. After being completely cured or dried, the furnace cover is placed on the furnace and can be moved, typically, by mechanical means. When used in furnaces for which the covers are repeatedly removed on a daily basis, for example, to charge and stir the furnace, the placement and orientation of the interlocking construction joints is important. To prevent premature failure of the cover, the interlocking joints in the cover are placed parallel to the direction of travel of the cover. In other words, the joints are placed perpendicular to the leading edge of the dome (i.e., the edge of the dome that travels across the furnace first).

While embodiments and applications of the invention have been shown and described, it will be apparent to those skilled in the art that modifications are possible without departing from the inventive concepts herein described. For example, it is envisioned that the methods of construction shown and described above may be used to fabricate other cast furnace cover shapes, using other casting or gunning methods, and/or for use in other furnace applications other than electric-arc furnaces. It is understood, therefore, that the invention is capable of modification and therefore is not to be limited to the precise details set forth. Rather, various modifications may be made in the details within the scope and range of equivalents of the claims without departing form the spirit of the invention.

What is claimed is:

1. A method of constructing a refractory furnace cover comprising:

providing a molding form base having a molding surface;

providing an outer molding frame on the molding form base;

providing at least two substantially parallel inner molding members disposed across and dividing the molding surface into a first molding section, a second molding section, and a third molding section, the inner molding members each having a first molding surface and a second molding surface, the first molding surface having a protrusion located along its length and being located adjacent to and facing the first and second molding sections;

shotcreting refractory material in the first molded section of the furnace cover to form a first section;

shotcreting refractory material in the second molded section of the furnace cover to form a second formed section;

removing the inner molding members, thereby exposing substantially parallel slots formed in the first molded section and the second molded section by the protrusion in the inner molding members; and shotcreting refractory material in the third molded section to form a third formed section in contact with first and second molded sections, thereby forming interlocking keys in the slots of the first molded section and the second molded section.

2. The method of producing a refractory furnace cover according to claim 1, wherein the third formed section is located between the first formed section and second formed section, the third formed section having interlocking keys formed in the slots of the first formed section and second formed section formed by the first molding surfaces removed therefrom.

3. The method of producing a refractory furnace cover according to claim 1, wherein a release layer is provided on the molding form base prior to casting.

4. The method of producing a refractory furnace cover according to claim 1, wherein the outer molding frame is a circular ring.

5. The method of producing a refractory furnace cover according to claim 1, wherein the outer molding frame is a circular metal ring incorporated into the furnace cover and comprises a "c"-channel cross-section.

6. The method of producing a refractory furnace cover according to claim 1, wherein the outer frame further comprises a double-walled cross-section defining an air cooling chamber.

7. The method of producing a refractory furnace cover according to claim 1, further comprising providing cross braces between the inner molding members.

8. The method of producing a refractory furnace cover according to claim 1, further comprising coating the molded sections with an insulating material.

9. The method of producing a refractory furnace cover according to claim 1, wherein the refractory furnace cover is in the shape of a dome.

* * * * *